US006966720B2

(12) United States Patent
Moss

(10) Patent No.: US 6,966,720 B2
(45) Date of Patent: Nov. 22, 2005

(54) TOILET CLEANING APPARATUS

(75) Inventor: Alan Brian Stanley Moss, Leeds (GB)

(73) Assignee: The London Oil Refining Company Limited, (GB)

( * ) Notice: Subject to any disclaimer, the term of this patent is extended or adjusted under 35 U.S.C. 154(b) by 0 days.

(21) Appl. No.: 10/312,270

(22) PCT Filed: Jan. 19, 2001

(86) PCT No.: PCT/GB01/00185

§ 371 (c)(1),
(2), (4) Date: Apr. 16, 2003

(87) PCT Pub. No.: WO01/97654

PCT Pub. Date: Dec. 27, 2001

(65) Prior Publication Data

US 2003/0152417 A1 Aug. 14, 2003

(30) Foreign Application Priority Data

Jun. 20, 2000 (GB) ..... 0014929

(51) Int. Cl.[7] ..... A46B 11/04; B43K 5/14

(52) U.S. Cl. ..... 401/273; 401/270; 401/134; 401/188 R

(58) Field of Search ..... 401/134, 188 R, 401/273, 272, 270, 276, 278, 279

(56) References Cited

U.S. PATENT DOCUMENTS

| | | | | | |
|---|---|---|---|---|---|
| 3,937,235 | A | * | 2/1976 | Broughton | 132/308 |
| 4,124,316 | A | * | 11/1978 | O'Rourke | 401/184 |
| 4,764,044 | A | * | 8/1988 | Konose | 401/150 |
| 5,039,244 | A | * | 8/1991 | Cheng | 401/176 |
| 5,984,555 | A | | 11/1999 | Samad | |
| 6,050,736 | A | * | 4/2000 | Gonzalez | 401/281 |
| 6,315,481 | B1 | * | 11/2001 | Gavorski et al. | 401/150 |

FOREIGN PATENT DOCUMENTS

| | | |
|---|---|---|
| BE | 478288 | 1/1949 |
| CH | 538 829 A | 7/1973 |
| DE | 4016353 A1 | 12/1990 |
| EP | PCT/GB01/00185 | 5/2001 |

* cited by examiner

*Primary Examiner*—David J. Walczak
(74) *Attorney, Agent, or Firm*—Schein & Cai LLP; Daniel B. Schein, Esq.

(57) ABSTRACT

A toilet cleaning apparatus comprising a toilet brush head; a toilet brush handle (2) separated from the brush head by a brush shaft (1); a portion of the brush handle being adapted to contain a cleaning fluid and being in fluid communication with the brush head by a conduit; the handle being adapted to be reciprocally displaced along the conduit between a first position remote from the brush head and a second position proximate to the brush head so urging cleaning fluid from the handle to the brush head; and, a non return valve within the conduit adapted to allow the flow of fluid from handle to brush but to prevent the flow of fluid from brush to handle.

11 Claims, 3 Drawing Sheets

TOILET CLEANING APPARATUS

The present invention relates to a toilet cleaning apparatus. More particularly, but not exclusively, the present invention relates to a toilet brush for dispensing a predetermined volume of cleaning fluid.

Toilet brushes for cleaning the bowls of toilets are well known. In use, one typically applies a cleaning fluid such as a disinfectant to a toilet bowl and then uses the brush to clean the bowl. However, such a known brush and associated cleaning method has the drawbacks that users typically apply too much cleaning fluid to the bowl. This is both expensive and harmful to the environment. In some countries the use of bleach as a toilet cleaner is banned for this reason.

U.S. Pat. No. 5,984,555 discloses a brush comprising a brush head in fluid communication with a hollow brush handle. In use, a plunger is urged along the interior of the handle so dispensing fluid from the handle to the bristles of the brush head. With such a brush the cleaning fluid is dispensed accurately to the brush head. However, when using such a brush it is difficult to control the exact amount of cleaning fluid dispensed; the further one presses the plunger the more fluid is dispensed. With such a brush users tend to use too much cleaning fluid which is harmful to the sewage destroying bacteria in the sewage system.

Accordingly, the present invention provides a toilet cleaning apparatus comprising a toilet brush head;

a toilet brush handle separated from the brush head by a brush shaft;

a portion of the brush handle being adapted to contain a cleaning fluid and being in fluid communication with the brush head by a conduit;

the handle being adapted to be reciprocally displaced along the conduit between a first position remote from the brush head and a second position proximate to the brush head so urging cleaning fluid from the handle to the brush head; and, a non return valve within the conduit adapted to allow the flow of fluid from handle to brush but to prevent the flow of fluid from brush to handle.

The apparatus according to the invention has the advantage that by reciprocally displacing the handle between first and second positions one can dispense a predetermined amount of cleaning fluid. This prevents over use of cleaning fluid.

In addition the apparatus according to the invention has the advantage that the non-return valve prevents the cleaning fluid from being sucked back into the handle from the brush so keeping the contents of the brush handle are kept sterile.

Preferably, the brush handle comprises an air input valve for introducing air into the brush handle. Such a valve enables air to be introduced into the handle after cleaning fluid has been dispensed, so returning the pressure within the handle to its initial value.

The portion of the handle adapted to contain the cleaning fluid can be adapted to be detached from the shaft. The portion, once empty, can be simply detached from the cleaning apparatus and replaced with a full portion.

The non return valve can comprise a plug positioned within the conduit, the plug being in contact with a seat within the conduit so preventing the flow of cleaning fluid from the handle to the brush;

the plug being arranged such that on urging the handle towards the first position the increase in fluid pressure within the handle separates the plug from the seat so urging cleaning fluid to flow from the handle to the brush.

Such a plug provides a simple means of ensuring that the cleaning fluid can flow from the handle to the brush, but not in the opposite direction.

The plug can be urged into contact with the seat by means of a resiliently deformable member, preferably a spring.

The apparatus can further comprise a piston slideable within the conduit in response to the displacement of the handle between first and second positions so urging a portion of the cleaning fluid in a dispensing volume between the piston and the non return valve through the non return valve. The use of a slideable piston defining a dispensing volume provides a reliable means for ensuring a defined volume of cleaning fluid is dispersed by the apparatus each time the handle is depressed from the second to first positions. The volume of the dispensing volume can be arranged to be small, so ensuring that only a small controlled volume of cleaning fluid is dispensed when the handle is displaced from the first to second positions. This reduces the harmful effect of the bleach to the sewage system.

The piston can comprise a non return refill valve adapted to prevent flow of cleaning fluid from the dispensing volume to the handle but to allow flow of cleaning fluid from the handle to the dispensing volume when the fluid pressure within the handle exceeds the pressure within the dispensing volume by a predetermined amount. This allows the dispensing volume to be refilled after each dispensing cycle.

The piston can comprise a refill conduit extending through the piston allowing the flow of cleaning fluid from the handle to the dispensing volume; the refill valve preferably comprising a plug located within the refill conduit urged into contact with the seat by an urging means so preventing the flow of cleaning fluid through the refill conduit whilst they are in contact. The urging means can comprise a resiliently deformable member, preferably a spring.

The present invention will now be described by way of example only and not in any limitative sense with reference to the accompanying drawings in which.

Figure 1:
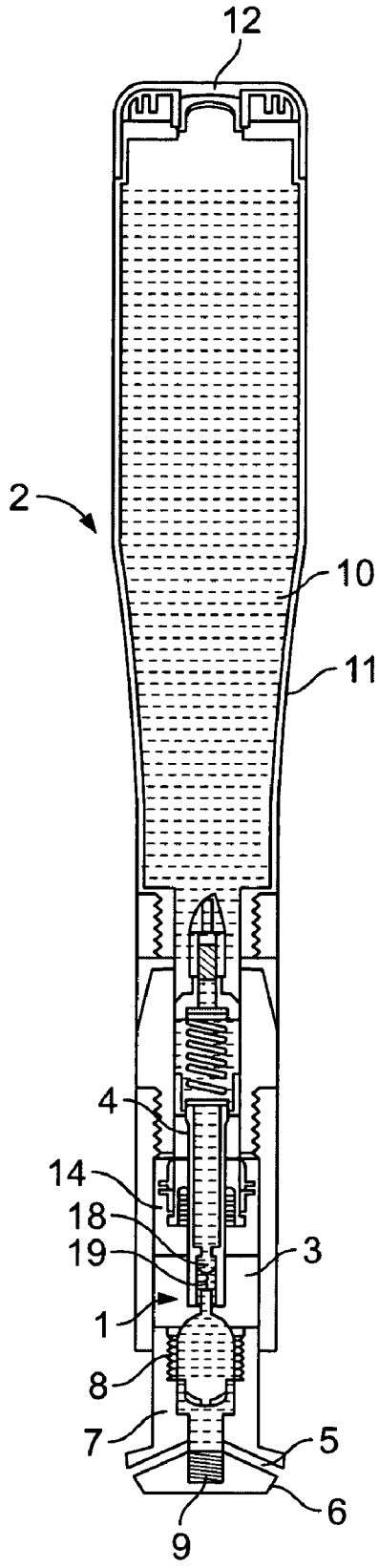
FIG. 1 shows in cross section, a toilet cleaning apparatus according to the invention with the brush handled urged towards a first position.

Shown in FIG. 1 in cross section are toilet brush shaft (1) and toilet brush handle (2) portions of toilet cleaning apparatus according to the invention. The toilet brush shaft (1) comprises a support wall (3) defining a conduit (4) extending along the shaft (1) between a toilet brush handle (2) and the brush head (not shown). Proximate to the toilet brush head the conduit (4) splits into a number of sub conduits (5) which lead to apertures (6) opening at a number of points on the brush head. These ensure that the cleaning fluid which flows along the conduit (4) towards the brush head is spread evenly by the sub conduits (5) over the brush head and onto the bristles. The portion (7) of the brush shaft (1) comprising the sub conduits (5) is connected to the remainder of the brush shaft (1) by a screw thread (8). This enables simple removal of this portion (7) should it need to be cleaned or replaced.

The brush shaft (1) further comprises a threaded recess (9) for receiving a screw thread of the brush head. This enables simple separation of the brush shaft (1) and the brush head should this be necessary for example to clean or replace the brush head.

Extending from the opposite end of the brush shaft (1) to the brush head is the brush handle (2). The brush handle (2) comprises a hollow portion (10) for containing cleaning fluid. The outer wall (11) of this portion (10) is gripped by the user during use. Extending through the wall (11) of this portion (10) of the brush handle (2) is an air input valve (12) which allows the passage of air into the hollow portion (10) when the pressure in this portion (10) drops below air pressure.

In threaded engagement with the hollow portion (10) is a cylinder portion. The inner wall (14) of the cylinder portion defines a further part of the fluid conduit. This part of the fluid conduit extends between the hollow portion (10) of the brush handle (2) and the fluid conduit (4) defined by the brush shaft (1). By means of this conduit cleaning fluid can flow from storage in the brush handle (2) to the brush head.

The cylinder portion of the brush handle (2) overlaps a toilet brush shaft (1) forming an airtight seal therebetween. When applying pressure to the brush handle (2), the handle (2) can be slid over the brush shaft (1) between the first position proximate to the brush head and a second position remote from the brush head.

Located within the conduit is a first seat member (16) comprising a restriction in the conduit (4) through which the cleaning fluid must flow. A non return valve (17) comprising a first plug (18) is urged into contact with the first seat member (16) by a first spring (19) as shown. The first spring (19) urges the first plug (18) into contact with the first seat member (16) in a direction away from the brush head. This ensures that when the cleaning fluid pressure on the brush head side of the non return valve (17) exceeds that on the opposite side of the valve (17) the first plug (18) is urged more firmly into contact with the first seat (16) so preventing fluid flow away from the brush head. However, when the pressure on the brush head side of the non return valve (17) is less than that on the opposite side. The pressure urges the first plug (18) away from the first seat (16). When the pressure differences are such that the cleaning fluid applies a force on the first plug (18) which is greater than the force applied to the first spring (19), the first plug (18) separates from the first seat (16) allowing the flow of cleaning fluid through the first seat (16) towards the brush head.

Figure 2:
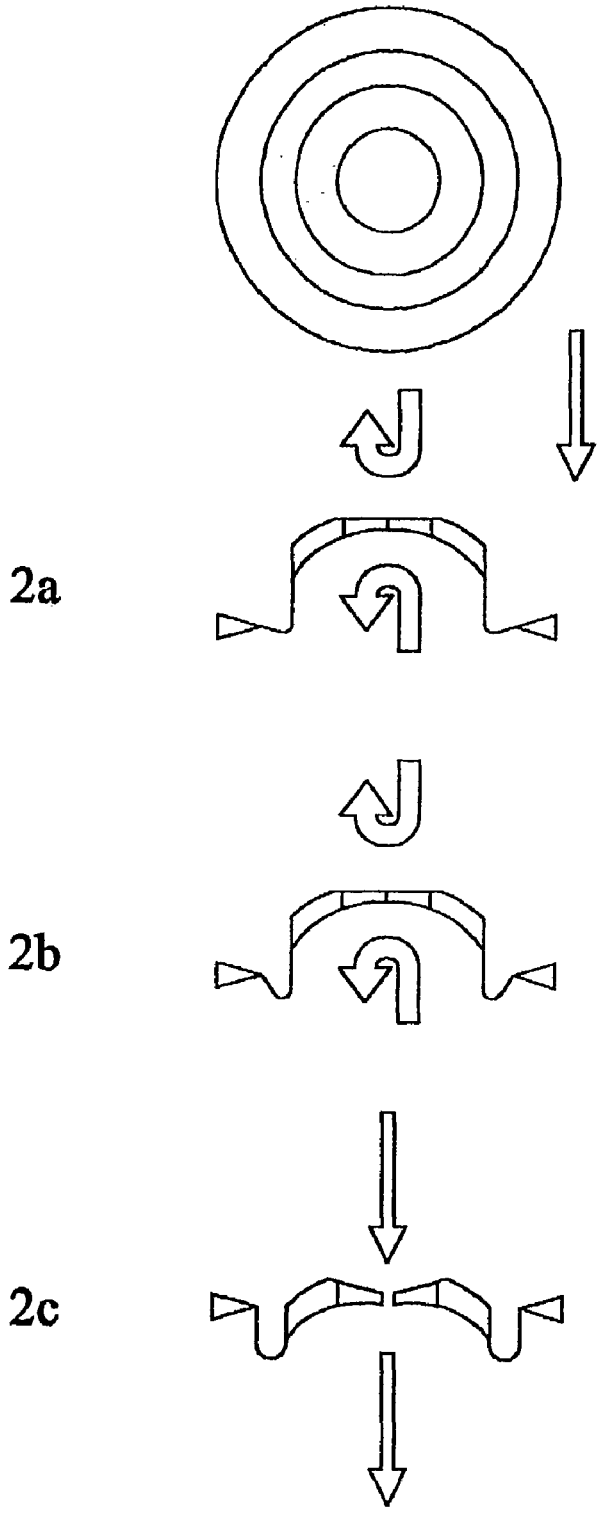
FIG. 2 shows in cross section a resiliently deformable valve located with the toilet cleaning apparatus.
Figure 3:
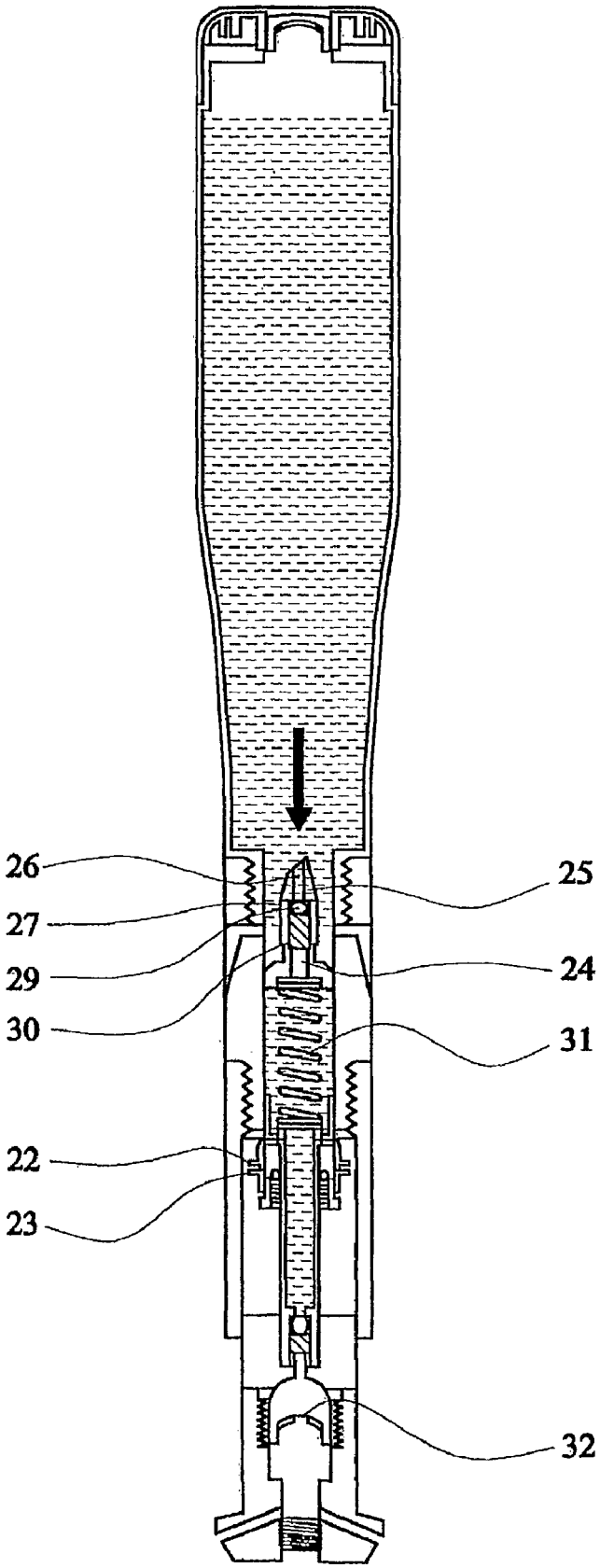
FIG. 3 shows in cross section, a toilet cleaning apparatus according to the invention with the brush handle urged towards what was the second position.

Positioned between the first seat (16) and the brush head is a first value 32 made from a resiliently deformable material, preferably silicone. The valve is shown in cross section in FIGS. 2*a* to 2*c*. The valve comprises a base sealingly attached to a conduit wall surrounding the valve. Positioned within the base is a deformable crown comprising self sealing lips. In FIG. 2*a* the pressure on the two sides of the valve is equal and the sealing lips are inter-engaged preventing the flow of fluid through the valve. As the pressure on one side of the valve increases, the valve starts to deform (FIG. 2*b*). Eventually the valve deforms sufficiently for the lips to separate allowing fluid to flow through the valve (FIG. 2*c*). As the pressure equalises the lips re-seal preventing further fluid flow. This seal prevents fluid "dripping" from the conduct on to the brush head if the brush is left standing in a vertical position for a long period. The air input valve (12) comprises an identical valve for allowing the entry of air into the hollow portion of the valve handle.

Also located within the conduit (4) is a piston (20) which defines a dispensing volume (21) within the shaft (1). A flange (22) on the piston (20) overlaps a flange (23) on the brush handle (2) so that displacement of the brush handle (2) between the first and second positions induces a corresponding displacement of the piston (20) within the conduit (4). Extending through the piston (20) is a refill conduit (24) enable cleaning fluid to flow from the handle (2) to the piston (20) to the dispensing volume (21). Extending from the refill conduit (24) is a piercing member (25). A piercing member conduit (26) extends through the piercing member (25) as shown. The joint between the piercing member conduit (26) and the refill conduit (24) defines a refill seat (27). A refill valve comprising a refill plug (29) is urged into contact with the seat (27) by means of a refill spring (30). When the fluid pressure within the dispensing volume (21) exceeds that in the handle (2) the refill plug (29) is urged further into contact with the refill seat (27) so preventing flow along the roof of conduit (24). If however, the pressure in the handle (2) exceeds that in the dispensing volume (21) by a sufficient degree to overcome the action of the refill spring (30) then the refill plug (29) will separate from the refill seat (27) allowing fluid to flow from the handle (2) into the dispensing volume (21).

Finally, also positioned within the conduit (4) is a piston spring (31) which urges the piston (20) away from the brush head. The function of this is described in detail below.

In use the handle portion (10) containing cleaning fluid is threadably engaged within the associated cylinder portion of the brush handle. As the portions (10) are threaded together the piercing member (25) pierces a thin foil cap (not shown) allowing cleaning fluid to flow from the handle portion (10).

Initially, the cleaning fluid will flow along the piercing member conduit (26) to the refill valve. Assuming the fluid pressure in the handle portion (2) is greater than that in the dispensing volume (21) the fluid pressure will open the refill valve allowing fluid to flow into the dispensing volume (21) until the fluid pressures in the handle (2) in the dispensing volume (21) are substantially equal.

As no force is being applied to the handle (2) the piston spring (31) urges the piston (20) and the handle (2) away from the brush head.

In order to dispense cleaning fluid from the handle (2) to the brush head, the brush head is held stationery and the handle (2) urged towards the head. Displacement towards the handle (2) wraps the piston (20) towards the brush head. This reduces the dispensing volume (21) causing the fluid pressure within the dispensing volume to rise. Eventually, the pressure within the dispensing volume (21) is sufficient to allow the first plug (18) to separate from the first seat (16). This enables the cleaning fluid to flow from the dispensing volume (21) through the diaphragm (32) along the sub conduits (5) and onto the brush head. During this time the refill valve (28) remains closed preventing the flow of cleaning fluid from the handle to the dispensing volume (21). Hence, as the cleaning fluid flows onto the brush head the fluid pressure within the dispensing volume (2) drops and eventually the refill valve (28) closes.

In order to complete the action the handle (2) is then urged to the second position away from the brush head. This causes a corresponding displacement in the piston (20) so increasing the dispensing volume (21). As both the non return and refill valves (17,28) are closed; this causes closes a drop in pressure in the dispensing volume (21). Once the pressure in the dispensing volume drops sufficiently for the pressure difference across the refill valve (28) to cause the refill plug (29) to separate from the refill seat (27) allowing cleaning fluid to flow from the handle (2) to the dispensing volume (21). Once the fluid pressure the dispensing volume (21) is substantially equal to that in the handle the refill valve (28) closes.

Finally, since cleaning fluid has passed from the handle (2) to the dispensing volume (21) the fluid pressure within the handle (2) will have dropped. Consequently, the air input valve (12) opens allowing air to flow into the handle (2) until the pressure within the handle (2) returns to its initial value so completing the dispensing cycle.

What is claimed is:

1. A brush shaft for connection between a brush handle and a brush head, said brush shaft comprising:

a support wall defining a fluid conduit extending along said brush shaft;

a first valve disposed in said fluid conduit proximate a brush shaft brush head end at a distal end of said shaft;

a refill valve disposed in said fluid conduit proximate a brush shaft brush handle end at a proximal end of said shaft; and a non return valve disposed in said fluid conduit intermediate said first valve and said refill valve, said refill valve being in fluid connection with said fluid conduit and a threaded opening at said brush handle end of said shaft for receiving fluid via said opening from a source proximal thereof, wherein said shaft functions with a fluid source that permits fluid to flow through said refill valve without causing a sustained substantial pressure drop in a proximal source of fluid, wherein said fluid conduit comprises a dispensing volume defined by a piston disposed in said fluid conduit.

2. The brush shaft of claim 1, wherein said first valve comprises a deformable valve.

3. The brush shaft of claim 1, further comprising a piston spring disposed in said dispensing volume.

4. The brush shaft of claim 1, wherein said piston comprises a refill conduit extending therethrough.

5. The brush shaft of claim 4, further comprising a piercing member extending from said refill conduit.

6. The brush shaft of claim 5, wherein said piercing member comprises a piercing conduit extending therethrough.

7. The brush shaft of claim 1, wherein said refill valve comprises a refill plug urged against a refill seat by a refill spring.

8. The brush shaft of claim 1, wherein said non return valve comprises a first plug urged against a first seat member by a first spring.

9. The brush shaft of claim 1, wherein said conduit further comprises a plurality of sub conduits disposed at a conduit brush head end.

10. The brush shaft further claim 1, further comprising a threaded recess disposed at said brush shaft brush head end, said threaded recess adapted to receive a screw thread of a brush head.

11. A brush shaft for connection between a brush handle and a brush head, said brush shaft comprising:

a support wall defining a fluid conduit extending along said brush shaft;

a first valve disposed in said fluid conduit proximate a brush shaft brush head end at a distal end of said shaft;

a refill valve disposed in said fluid conduit proximate a brush shaft brush handle end at a proximal end of said shaft; and a non return valve disposed in said fluid conduit intermediate said first valve and said refill valve, said refill valve being in fluid connection with said fluid conduit and a threaded opening at said brush handle end of said shaft for receiving fluid via said opening from a source proximal thereof, wherein said shaft functions with a fluid source that permits fluid to flow through said refill valve without causing a sustained substantial pressure drop in a proximal source of fluid, wherein said threaded opening is adapted to receive a brush handle comprising a hollow portion for containing cleaning fluid and an air input valve for allowing air into said hollow portion thereby permitting fluid to flow through said refill valve without causing a sustained substantial pressure drop in said hollow portion.

* * * * *